United States Patent [19]

Rowe et al.

[11] 4,286,913

[45] Sep. 1, 1981

[54] DUMPABLE CROP BAR CONTAINER

[75] Inventors: Joseph R. Rowe, Carrollton; Eugene T. Sanders, Newnan, both of Ga.

[73] Assignee: Southwire Company, Carrollton, Ga.

[21] Appl. No.: 93,341

[22] Filed: Nov. 13, 1979

[51] Int. Cl.[3] ..... B66F 9/19

[52] U.S. Cl. ..... 414/422; 414/607; 414/608; 414/642

[58] Field of Search ..... 414/607, 608, 609, 610, 414/639, 642, 645, 646, 647, 652, 303, 422

[56] References Cited

U.S. PATENT DOCUMENTS

| | | | |
|---|---|---|---|
| 2,482,692 | 9/1949 | Quales et al. | 414/647 X |
| 2,956,701 | 10/1960 | Larson | 414/608 X |
| 3,129,833 | 4/1964 | Townsend | 414/607 X |
| 3,270,900 | 9/1966 | Sherman | 414/607 X |
| 3,877,593 | 4/1975 | Sleziak | 414/607 X |

FOREIGN PATENT DOCUMENTS

| | | | |
|---|---|---|---|
| 534418 | 2/1977 | U.S.S.R. | 414/642 |
| 650937 | 3/1979 | U.S.S.R. | 414/652 |

*Primary Examiner*—James L. Rowland

*Attorney, Agent, or Firm*—Herbert M. Hanegan; Stanley L. Tate; Robert S. Linne

[57] ABSTRACT

An improved apparatus for collecting, storing, transporting and dumping cropped (cut) sections of continuously cast bar. The present invention is embodied in a dumpable crop bar container generally comprising a yoke and rear stanchion assembly surrounding and pivotally attached to a receptacle and front stanchion assembly by an axle and sleeve assembly. A conventional forklift is used to transport the present invention and to discharge collected crop bar from it. The forklift pushes the front stanchions against a stationary curb, forcing them to pivot inward and upward on the axle which cause the receptacle rigidly affixed thereto to pivot upward and outward. The base of the receptacle pivots to almost vertical and all of the crop bar is dumped out. As the fork lift backs away from the stationary curb, the weight of the receptacle and front stanchion assembly returns it to its original position.

8 Claims, 5 Drawing Figures

DUMPABLE CROP BAR CONTAINER

BACKGROUND OF THE INVENTION

The present invention relates generally to material handling, and specifically to an improved apparatus for collecting, sorting, transporting and dumping cropped sections of continuously cast bar.

Cropping of cast bar is necessary when portions of a continuous casting and rolling operation break down or must be shut down. At these times, molten metal between the furnace and the mold must continue through the casting process until repairs can be made or until the entire operation can be shut down. The hot cast bar is cropped, or cut into short sections immediately after casting and removed from its usual path for later remelting.

Prior art methods of handling cropped (cut) sections of cast bar are rather primitive. They are limited to handling sections of crop bar in loose piles or handling them in bins which are difficult to store, transport and unload.

The present invention is much more efficient because it is a durable multipurpose dumpable container for cropped bar.

SUMMARY OF THE INVENTION

This invention comprises a yoke and rear stanchion assembly surrounding and pivotally attached to a receptacle and front stanchion assembly by an axle and sleeve assembly.

Hot cropped bar is collected in the present invention as the need arises during the casting process and when the receptacle of the present invention is filled, the container may be removed to storage or for immediate remelting by means of a common industrial lift truck and replaced by an empty dumpable cropbar container.

If the cropped bar collected in the container of the present invention is to be immediately remelted, the container, when filled, is transported to the desired dumping area by means of the lift truck. To dump the contents of the container, a front bumper located on the front stanchions of the receptacle and front stanchion assembly is pushed against a stationary curb thereby causing the receptacle and front stanchion assembly to pivot on an axle whereby the contents are dumped. As the forklift backs away from the stationary curb, the weight of the receptacle and front stanchion assembly causes the assembly to return to its original position.

Thus it is an object of the present invention to provide an easily transportable container for collecting crop bar which is constructed of pivotally connected components for rapid, easy unloading of the container by a dumping action.

Another object of this invention is to provide an improved container with certain components constructed of heat resistant steel because of the extremely high temperature of crop bar immediately after casting.

Still another object of the present invention is to provide a container as described above with a safety latch to prevent the receptacle from pivoting out of the assembly if accidently bumped while sitting empty.

Yet another object of this invention is to increase crop bar recycling efficiency by providing a container which is easily and quickly moved and unloaded.

Another object of the present invention is to save wear and tear on floors, forklifts and loading surfaces by providing a crop bar container which cooperates with forklifts and accurately dumps crop bar where desired.

Still another object of this invention is to provide a method of returning the receptacle to its loading or base position after all crop bar has been dumped by regulating pivotal upward and outward movement to less than 90 arcuate degrees so that the weight of the receptacle always tends to return the receptacle toward the loading or base position; by limiting the pivotal downward and inward movement to exactly base position; and by providing guides on either side of the receptacle to align its return movement.

Yet another object of this invention is to make recycling hot crop bar much safer by providing a dumpable crop bar container which easily dumps its contents without the need of close manual manipulation by personnel, which can result in severe burns.

BRIEF DESCRIPTION OF THE DRAWINGS

While the specification concludes with claims particularly pointing out and distinctly claiming the subject matter which is regarded as the invention, it is believed that the invention, objects, features and advantages thereof will be better understood from the following description taken in connection with accompanied drawings in which like parts are given like identification numerals and wherein:

FIG. 1 is a side view of the preferred embodiment in loading or base position; while

DESCRIPTION OF THE PREFERRED EMBODIMENT

Figure 1:
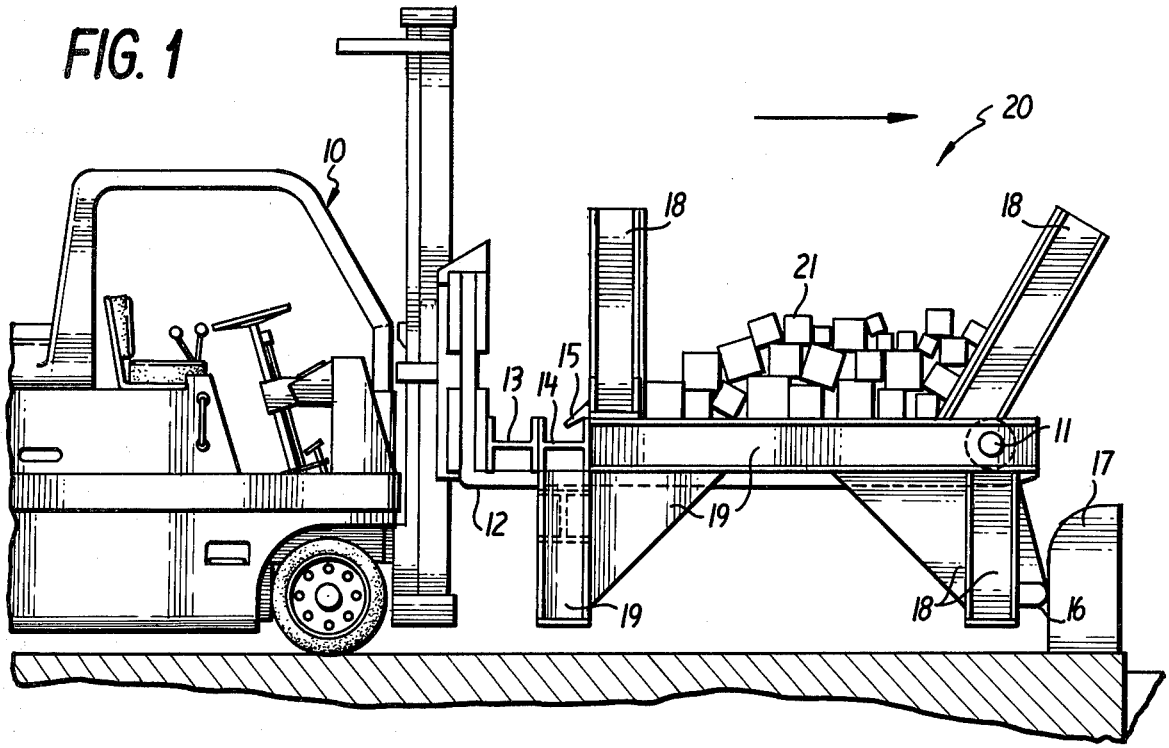

The present invention is preferably manufactured from heat resistant steel because of the extremely high temperature of crop bar immediately after casting. Most frame members are made of "I" beam steel for strength. These "I" beam frame members are preferably all of the same cross-sectional area and configuration which have equal width and depth so that "I" beam frame member junctures can be square and flush when any surface of one member is joined to any surface of another member.

Simply stated, a forklift-type truck (10, FIG. 1) engages container 20 from the rear which is the end opposite the axle and sleeve assembly 11, and moves forward until the upright portions of its fork arms 12 contact the rear bumper 13 of the container 20. Fork arms 12 are elevated until the top surface of their horizontal portions contact cooperating portions of container 20 thereby maintaining it in a stable and level attitude during horizontal and vertical movement. Rear cooperating surfaces are the bottoms of the rear bumper 13, the yoke rear beam 14 and the receptacle rear beam (not shown). Front cooperating surface is the bottom of the outer sleeve 41 of the axle and sleeve assembly 11. After the safety latch 15 is released, the container 20 is ready to dump.

Figure 2:
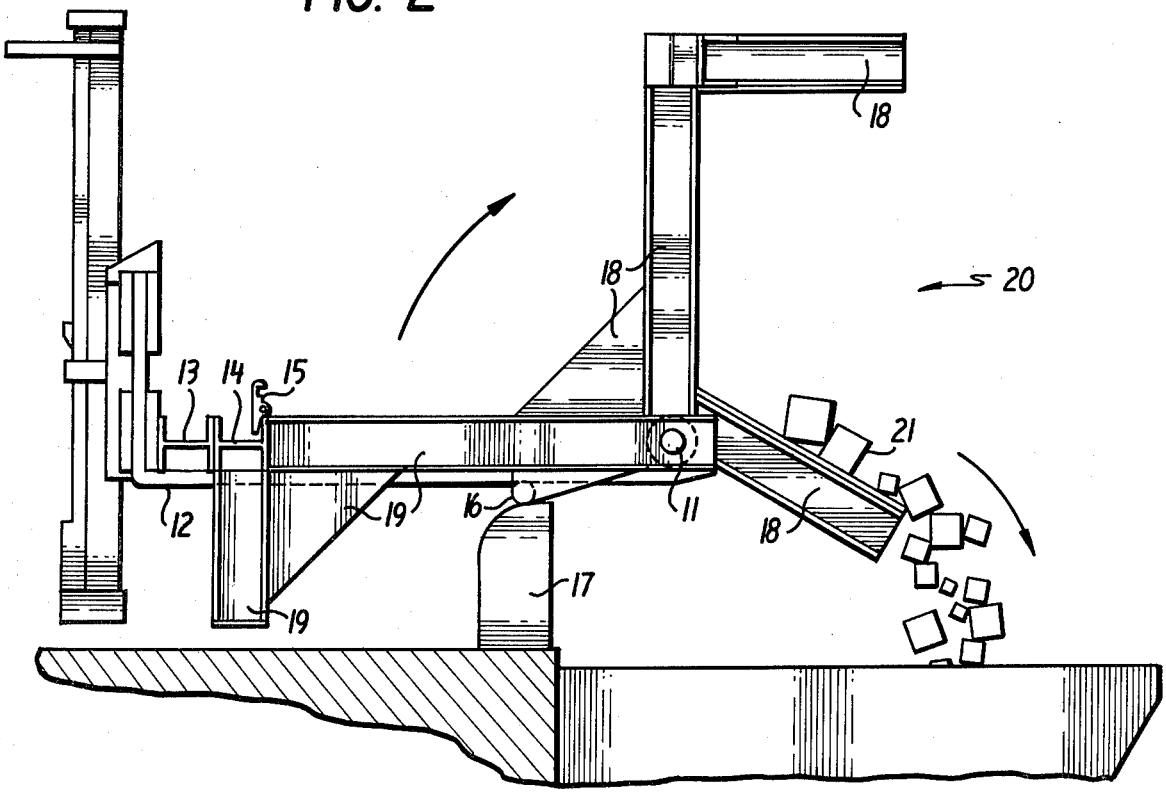
FIG. 2 is a side view of the preferred embodiment in dumping position.

As FIG. 2 shows, crop bar 21 collected in container 20 is dumped by using the forklift 10 to push a front bumper/stop 16 against a stationary curb 17. As the front bumper/stop pivots on the axle and sleeve assembly 11, it rotates inward (toward the forklift) and upward and the receptacle and front stanchion assembly 18 rotates upward and outward (away from the forklift), out of the yoke and rear stanchion assembly 19 to a terminal dumping position which allows the crop bar to fall out of the container. The forklift 10 backs away from the stationary curb 17 and the receptacle and front stanchion assembly 18 returns to its original base or receiving position.

Figure 3:
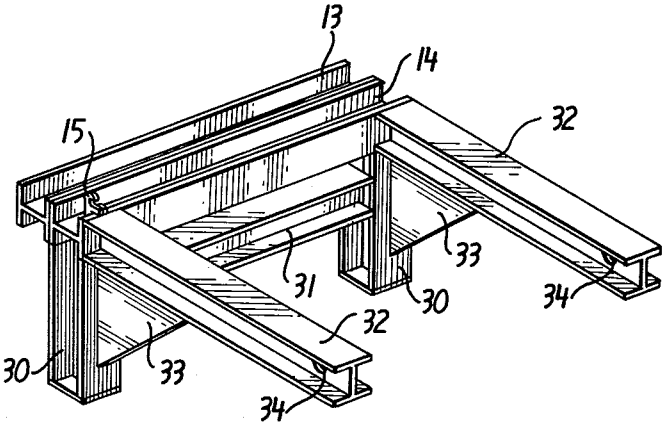
FIG. 3 is a perspective view of the yoke and rear stanchion assembly.

FIG. 3 is a more detailed view of the yoke and rear stanchion assembly 19. The yoke is basically "U" shaped with a pair of rear stanchions 30 to hold it off the floor. The rear stanchions 30 are laterally spaced and braced by a horizontal rear stanchion brace beam 31. Atop the rear stanchions 30, a horizontal yoke rear beam 14 is attached with its longitudinal ends flush with the outside surfaces of the rear stanchions 30. A safety latch 15 is mounted on the yoke rear beam 14. Its latch hook snaps over the rear stop 55 between the rear receptacle upright beams 57 shown in FIG. 5 and is adapted to prevent the receptacle and front stanchion assembly 18 from accidentally pivoting out of the yoke and rear stanchion assembly 19. Yoke side beams 32 are attached to the front surface of the yoke rear beam 14 flush with the top and the longitudinal ends of the yoke rear beam 14 and perpendicular to the rear stanchion 30 and to the yoke rear beam 14. A triangular rear stanchion brace gusset 33 preferably connects each yoke side beam 32 to its corresponding rear stanchion 30 for strength and stability. Near the front of each yoke side beam 32 is a yoke axle aperture 34 horizontally located through its center for mounting the axle and sleeve assembly 11 so as to be generally parallel to the yoke rear beam 14 an perpendicular to the yoke side beams 32. A rear bumper 13 is preferably attached to the back of the yoke rear beam 14 parallel to and at the same elevation as the yoke rear beam 14. This rear bumper 13 serves as a forklift bumper to keep the main body of container 20 away from direct horizontal contact with the forklift 10 to reduce the possibility of damage to container 20. The rear bumper 13 also helps regulate the overall front to back dimension of container 20 to assure proper fork arm 12 contact without extending the fork arms 12 past the front of container 20 to interfere with handling.

Figure 5:
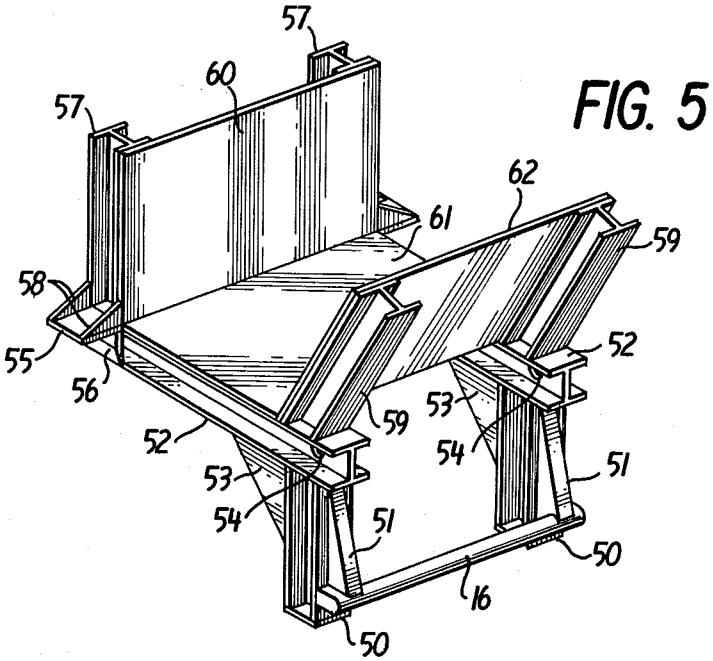
FIG. 5 is a perspective view of the receptacle and front stanchion assembly.

FIG. 5 illustrates the rigid receptacle and front stanchion assembly 18, which is designed to fit inside the yoke and rear stanchion assembly 19 with but little clearance. The front stanchions 50 extend vertically a distance equal to that of the rear stanchions 30 to put the frames of the two assemblies 18 and 19 in the same general horizontal plane. A front bumper/stop 16 is attached horizontally to the lower front surface of the front stanchions 50, and is preferably braced on each end by front bumper/stop gussets 51. The front bumper/stop 16 serves as a bumper for contacting the stationary curb 17 during dumping and as a dumping rotation stop by contacting the bottom surface of the horizontal portions of the fork arms 12. Atop each front stanchion 50 is a receptacle side beam 52 preferably flush with the front and side of each front stanchion 50 and extending horizontally to the rear and perpendicularly to each front stanchion 50. For dumping clearance, the longitudinal dimension of each receptacle side beam 52 is less than that of its corresponding yoke side beam 32. Near the front of each receptacle side beam 52 is a receptacle axle aperture 54 horizontally through its center for hingedly connecting the two assemblies 18 and 19 with the axle and sleeve assembly 11. A triangular front stanchion brace gusset 53 preferably connects each receptacle side beam 52 to its corresponding front stanchion 50 for strength and stability. A receptacle rear beam (not shown) is attached to the inside of the receptacle side beams 52 flush with its rear, top and bottom surfaces thus forming a horizontal receptacle frame. An elongated heavy steel plate is attached atop the receptacle rear beam (not shown), with its end extending past the outsides of the receptacle side beams 52 approximately the width of the yoke side beams 32. This plate is the rear stop 55 which terminates downward and inward movement when the receptacle and front stanchion assembly 18 returns to base or empty position inside the yoke and rear stanchion assembly 19. The top surface of the rear stop 55 near its longitudinal center also serves as a catching surface for the safety latch 15. Below each rear stop 55 is a wedge shaped alignment guide 56 tapering from its outside top to its inside bottom to align the receptacle and front stanchion assembly 18 as it returns to base position. A pair of rear receptacle upright beams 57 extend vertically atop the rear stop plate 55. One is perpendicular to each receptacle side beam 52 and flush with the rear, inside and outside surface of each. Triangular rear stop gussets 58 brace extending rear stop 55 portions against the rear receptacle upright beams 57 to prevent bending the rear stops 55 by repeated use. Each receptacle side beam 52 has a forward leaning front receptable upright beam 59 attached to its top surface preferably flush with its sides and with one outer edge tangent to its top front edge. The front receptacle upright beams 59 extend upward at a forward angle of about 30 angular degrees past vertical. This forward angle allows crop bar 21 to easily fall from container 20 because when the receptacle and front stanchion assembly 18 rotates less than 90 angular degrees to dumping position, the front receptacle upright beams 59 will be about 20 angular degrees below horizontal thus no longer providing horizontal support for the crop bar. The receptacle is formed by attaching a receptacle back plate 60 between the rear receptacle upright beams 57, a receptacle base plate 61 between the receptacle side beams 52 and a receptacle front plate 62 between the forward leaning front receptacle upright beams 59. These plates 60, 61 and 62 help brace the receptacle and front stanchion assembly 18 to prevent independent movement by any section and provide a receptacle for containing crop bar 21.

Container 20 is assembled by inserting the rear of the receptacle and front stanchion assembly 18 into the front of the yoke and rear stanchion assembly 19 and moving it toward the rear until all axle apertures 34 and 54 align. The axle and sleeve assembly 11 is then rotatably secured. The front of the receptacle and front stanchion assembly 18 is supported by its front stanchions 50, and the front of the yoke and rear stanchion assembly 19 is supported by the receptacle and front stanchion assembly 18 through the axle and sleeve assembly 11. The rear of the yoke and rear stanchion assembly 19 is supported by its rear stanchions 30, and the rear of the receptacle and front stanchion assembly 18 is supported on the yoke side beams 32 by the rear stops 55. Thus, assembled in base or loading position, the two assemblies 18 and 19 reciprocally support each other.

Figure 4:
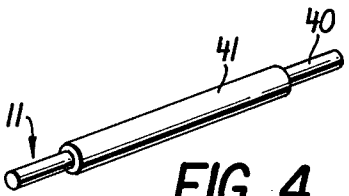
FIG. 4 is a perspective view of the axle and sleeve assembly.

The axle and sleeve assembly 11 is illustrated in more detail in FIG. 4. It hingedly connects the receptacle and front stanchion assembly 18 to the yoke and rear stanchion assembly 19 and provides additional lateral stability to both. The diameter and length of the axle 40 is such that it will extend through the axle apertures 34 and 54 in both assemblies 18 and 19. The diameter of the axle sleeve 41 is preferably equal to the height of the beams forming the horizontal frames of the two assemblies 18 and 19 such that when assembled, the bottom surfaces of each are generally in the same horizontal plane. Thus, a horizontally level lifting surface for cooperating with the fork arms 12 is created, which includes the rear bumper 13, the yoke rear beam 14, the receptacle rear beam (not shown) and the axle sleeve 41.

In operation, the forklift 10 in FIG. 1 has engaged the present invention from the rear. The fork arms 12 have traveled forward under the horizontal frames of container 20 between its rear stanchions 30 and between its front stanchions 50. Forward movement of the front tips of the fork arms 12 with respect to container 20 is limited to no more than flush with the front of container 20 by dimensional design of this invention including a rear bumper 13 which saves wear and tear on the main body of container 20 by keeping it a predetermined distance from the forklift 10. The fork arms 12 are raised until the top of their horizontal portions contact the bottom surfaces of the rear bumper 13, the yoke rear beam 14, the receptacle rear beam (not shown) and the axle sleeve 41. Thus, in proper cooperation, the forklift 10 elevates and holds container 20 substantially horizontally level. In this manner container 20 is easily transported with lateral and longitudinal stability.

To dump crop bar, the forklift 10 transports container 20 to a desired dumping location. The safety latch 15 is released and the forklift 10 elevates container 20 to a height sufficient to assure that the bottom of the horizontal frame portions of container 20 clear the top of the stationary curb 17 as the forklift 10 advances. As FIG. 2 illustrates, the forklift 10 advances forcing the front bumper/stop 16 attached to the front stanchions 50 against the stationary curb 17, and the front stanchions 50 pivot on the axle 40 in an inward and upward direction. This forces the rest of the rigidly attached receptacle and front stanchion assembly 18 to rotate upward and outward until the receptacle base plate 61 is almost perpendicular to its base position. Movement is terminated at this point by the front bumper/stop 16 which is elongated horizontally between the front stanchion 50 and halts movement by coming into contact with the fork arms 12. At this terminal or dumping position the forward leaning front receptacle upright beams 59 are about 20 angular degrees below horizontal and the crop bars 21 easily fall out of container 20 because they no longer have horizontal support and because of the outward inertia of the crop bars 21.

Since the center of gravity of the receptacle and front stanchion assembly 18 is always behind the pivot point, its weight, when empty, tends to force the assembly to return to its base position. Having dumped the contents, the forklift 10 backs away from the stationary curb 17, and the weight of the receptacle and front stanchion assembly 18 forces it to rotate inward and downward. As the receptacle and front stanchion assembly 18 nears its base position, alignment guides 56 direct it into proper alignment with the yoke and rear stanchion assembly 19. Rear stops 55 and the fork arms 12 come into contact with descending receptacle and front stanchion assembly 18 surfaces to terminate downward movement in the base position. The safety latch 15 is set in place and the dumpable crop bar container 20 is ready for transport to collect more crop bar 21.

What we claim as the invention is:

1. An apparatus for receiving, transporting and dumping pieces of bar with the assistance of a cooperating forklift truck, having extending fork arms, and adapted to contact a stationary curb which comprises:

rigid receptacle and front stanchion means for holding crop bar pivotally connected to;

yoke and rear stanchion means for pivotally holding said receptacle and front stanchion means; and pivot means connecting the front of said receptacle and front stanchion means to the front of said yoke and rear stanchion means whereby bar may be dumped from said apparatus by contacting said receptacle and front stanchion means with said stationary curb forcing said receptacle and front stanchion means to rotate about said pivot means from a receiving position through an arcuate path to a terminal dumping position thereby causing bar to fall from said apparatus.

2. The apparatus of claim 1 wherein said receptacle and front stanchion means comprises:

a receptacle having a pair of side beams with axle receiving apertures inscribed therein whereby said receptacle and front stanchion means is pivotally mounted within a yoke and rear stanchion means by an axle and sleeve means, the ends of which fit into said axle receiving apertures, said side beams having a pair of rear upright members and a pair of forward leaning front upright members rigidly attached thereto forming a receptacle frame to which a base plate, a rear plate and a front plate are attached thereby forming a container which restricts downward and lateral movement of said crop bar when said receptacle and front stanchion means is in said receiving position, with alignment guide means mounted on the outer side of said side beams adapted to assure correct alignment of said receptacle and front stanchion means when returning from a dumping position to said receiving position, said side beams further having rear stop means extending horizontally outward therefrom to terminate return rotation of said receptacle and front stanchion means; and a pair of front stanchions rigidly attached to said receptacle side beams, said front stanchions interconnected by a combination front bumper and stop means attached in a generally horizontal position therebetween so as to provide bumper means for contacting said stationary curb and thereby causing said receptacle and front stanchion means to pivot from said receiving position and stop in said terminal dumping position by contacting said combination front bumper and stop means with said fork arms.

3. The apparatus of claim 2 wherein said forward leaning front upright members and said front plate attached thereto extend upward at a discrete angle forward of vertical whereby when said receptacle and front stanchion means is in said terminal dumping position, said forward leaning front upright members and said front plate subtend a discrete angle below horizontal sufficient to dump said bars by limiting horizontal bar support and eliminating lateral crop bar support in a forward direction.

4. The apparatus of claim 2 further including return means for constantly pushing said receptacle and front stanchion means toward said receiving position, said return means being adapted to restrict the forward movement of the center of gravity of said receptacle and front stanchion means to such a point behind said axle and sleeve means whereby said receptacle and front stanchion means returns to said receiving position from said terminal dumping position and any intermediate position between said receiving position and said terminal dumping position.

5. The apparatus of claim 1 wherein said yoke and rear stanchion means further comprises:

a yoke consisting of a pair of side beams with axle receiving apertures inscribed therein whereby a receptacle and front stanchion means is pivotally mounted within said yoke and rear stanchion means by an axle and sleeve means, the ends of which fit into said axle receiving apertures; a rear beam interconnecting the rear faces of said side beams to form a yoke, said yoke including a rear bumper means for separating the main body of said apparatus from said cooperating forklift and for regulating overall front to back dimension to assure proper fork arm contact without extending fork arms past the front of said apparatus to interfere with handling; a safety latching means for releasably securing said receptacle and front stanchion means to said yoke and rear stanchion means to prevent accidental rotation of either assembly; and a pair of rear stanchions rigidly attached to said yoke at said rear beam and reinforced by rear stanchion brace means interconnecting said rear stanchions and said yoke.

6. The apparatus of claim 1 wherein said axle and sleeve means comprises:

an axle for pivotally connecting said receptacle and front stanchion means to said yoke and rear stanchion means; and a sleeve surrounding and rotatably connected to said axle and having a diameter equal to the height of frame members of said yoke and rear stanchion means whereby said yoke and rear stanchion means and said sleeve are maintained in the same plane for providing stability during the receiving and dumping of crop bar.

7. The apparatus of claim 1 wherein said yoke and rear stanchion means and said receptacle and front stanchion means reciprocally support each other while said apparatus is in said crop bar receiving position and is not elevated by said forklift by supporting the front of said yoke and rear stanchion means on said receptacle and front stanchion means through said axle and sleeve means, and by supporting the rear of said receptacle and front stanchion means on said yoke and rear stanchion means through rear stop means which are mounted on said receptacle such that when the bottom surfaces of said receptacle and front stanchion means contact the top of said yoke and rear stanchion means, the two assemblies stand parallel and in the same plane.

8. The apparatus of claim 1 further including rotational interference preventive means for preventing extension of the fork arms of said forklift past the front of said apparatus to avoid rotational interference.

* * * * *